United States Patent [19]

Kawanami et al.

[11] Patent Number: 5,021,011

[45] Date of Patent: Jun. 4, 1991

[54] CONNECTOR FOR COAXIAL CABLE

[75] Inventors: Norihide Kawanami; Fumio Kobayashi; Ikujiro Mitani, all of Tokyo, Japan

[73] Assignee: Hirose Electric Co., Ltd., Tokyo, Japan

[21] Appl. No.: 608,462

[22] Filed: Nov. 2, 1990

[30] Foreign Application Priority Data

Nov. 7, 1989 [JP] Japan ..... 1-129366

[51] Int. Cl.[5] ..... H01R 9/05

[52] U.S. Cl. ..... 439/582; 439/839

[58] Field of Search ..... 439/578, 585, 833, 839

[56] References Cited

U.S. PATENT DOCUMENTS 2,757,351 7/1956 Klostemann ..... 439/583

3,206,540 9/1965 Cohen ..... 439/578

4,799,900 1/1989 Capp et al. ..... 439/585

4,861,284 8/1989 Pauza et al. ..... 439/580

FOREIGN PATENT DOCUMENTS 483579 4/1938 United Kingdom ..... 439/839

*Primary Examiner*—Joseph H. McGlynn

*Assistant Examiner*—Hien D. Vu

*Attorney, Agent, or Firm*—Kanesaka & Takeuchi

[57] ABSTRACT

A coaxial cable connector includes a tubular outer conductive shell (1) having a coupling opening (8), a slit (5A) extending upwardly from the coupling opening, and an annular groove (10) on an outside surface adjacent the coupling opening; and a stop ring (11) loosely fitted over the annular groove and having a polygonal inner face.

1 Claim, 2 Drawing Sheets

CONNECTOR FOR COAXIAL CABLE

BACKGROUND OF THE INVENTION

1. Field of the Invention

The present invention relates to connectors for coaxial cables.

2. Description of the Prior Art

Coaxial cable connectors having a central terminal supported by a dielectric body within a tubular outer conductive shell are well known. The outer conductive shells are provided with a slit extending from the opening along the longitudinal axis. In addition, the shells are subjected to a drawing press, and a stop ring having a diameter substantially equal to the original diameter of the shell is fitted over the shell. When a mating connector is coupled, the outer shell resiliently expands and snaps over the mating connector. The stop ring prevents plastic deformation of the outer shell owing to excessive expansion.

Although the slit provides sufficient expansion of the outer shell, it is frequent to turn a mating connector back and forth in an attempt to forcefully plug it into/-out the outer shell, causing plastic deformation of the connector.

SUMMARY OF THE INVENTION

Accordingly, it is an object of the invention to provide a coaxial cable connector which is able to provide a satisfactory expansion of the outer shell without suffering any damage by forceful plugging operation.

According to the invention there is provided a coaxial cable connector which includes a tubular outer conductive shell having a coupling opening, a slit extending upwardly from the coupling opening, and an annular groove on an outside surface adjacent the coupling opening; and a stop ring loosely fitted over the annular groove and having a polygonal inner face.

When connected to a mating connector, the coaxial cable connector according to invention resiliently expands until the outer shell abuts on the stop ring and snaps on the mating connector. When the mating connector is forcefully plugged in/out by turning it back and forth, the stop ring undergo elastic deformation to permit the outer shell expand until it becomes substantially circular, thereby absorbing excessive plugging in/out forces. Thus, plastic deformation of the outer shell is prevented.

The above and other objects, features, and advantages of the invention will be more apparent from the following description when taken in connection with the accompanying drawings.

DESCRIPTION OF THE PREFERRED EMBODIMENT

Figure 1:
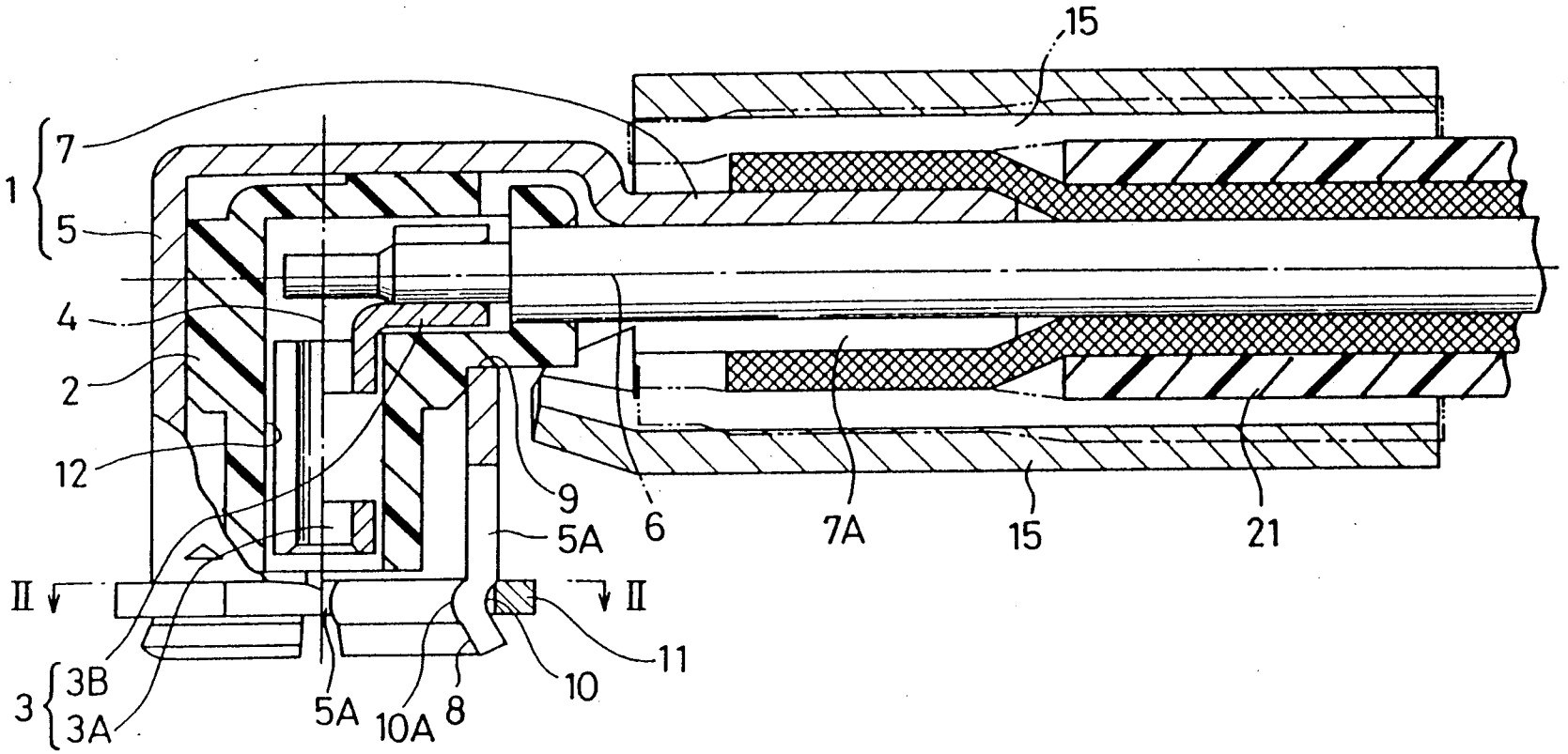
FIG. 1 is a longitudinal section of a coaxial cable connector to which a coaxial cable is connected according to an embodiment of the invention.

FIG. 1 shows a coaxial cable connector according to an embodiment of the invention. The connector includes an L-shaped outer conductive shell 1; an L-shaped dielectric body 2 placed within the outer shell 1; and an L-shaped central terminal 3 supported by the dielectric body 2. The outer shell 1 is made by stamping and forming a metal sheet to have a tubular trunk portion 5 about a vertical axis 4 and a tubular arm portion 7 extending laterally from the upper portion of the trunk portion 5 along a horizontal axis 6.

The trunk portion 5 has a coupling opening 8 for receiving a mating connector and a connection opening 9 for connection with a coaxial cable. A number of slits 5A extend upwardly from the lower edge of the trunk portion 5 which is then contracted so that it can resiliently expand to the original diameter. An annular groove 10 is formed adjacent the lower edge of the trunk portion 5 by means of a press. A stop ring 11 is loosely fitted over the annular groove 10.

Figure 2:
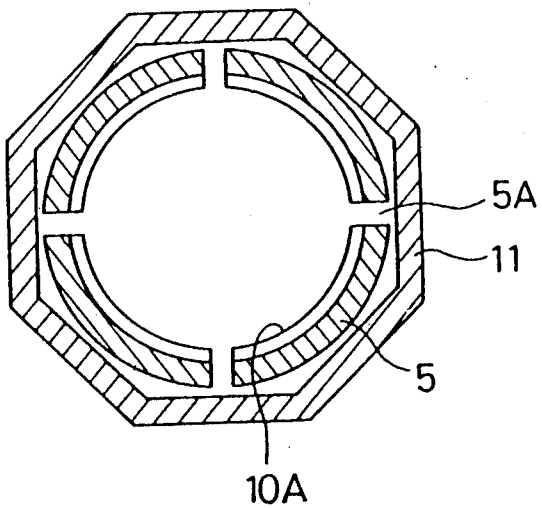
FIG. 2 is a sectional view taken along the line II—II of FIG. 1.

As FIG. 2 shows, the stop ring 11 has a polygonal inner face and defines gaps between its the smallest diameter portion and the annular groove 10. An annular projection 10A on the inner surface of the trunk portion 5 corresponding to the annular groove 10 snaps on the annular groove of a mating connector. The tubular arm portion 7 extends laterally from the trunk portion 5 and has a slit 7A extending along the horizontal axis 6.

The outer shell 1 is made by stamping a metal sheet into a shape having a constricted neck portion, bending the shaped sheet to form a tubular trunk portion 5 and a tubular arm portion 7 aligned in a straight line by means of a press, and then bending the formed shell at right angles at the neck portion to form a final L-shaped structure as shown in FIG. 1. The outer shell 1 has the L-shaped dielectric body 2 with an L-shaped channel 12 therein. The dielectric body 2 is pushed into the trunk portion 5 until the shoulder of the L-shaped dielectric body 2 abuts on the edge of the connection opening 9 before the outer shell 1 is bent at the neck portion.

The L-shaped central terminal 3 is placed in the L-shaped channel 12 and has an annular coupling portion 3A with slits about the vertical axis 4 for receiving the contact pin of a mating connector (not shown) and an annular connection portion 3B with a slit about the horizontal axis 6 for receiving the central conductor (or a reinforcing terminal fitted over the central conductor) of a coaxial cable. A crimp sleeve 15 is made of a relatively soft material to have an inside diameter greater than the outside diameter of a coaxial cable.

Figure 3:
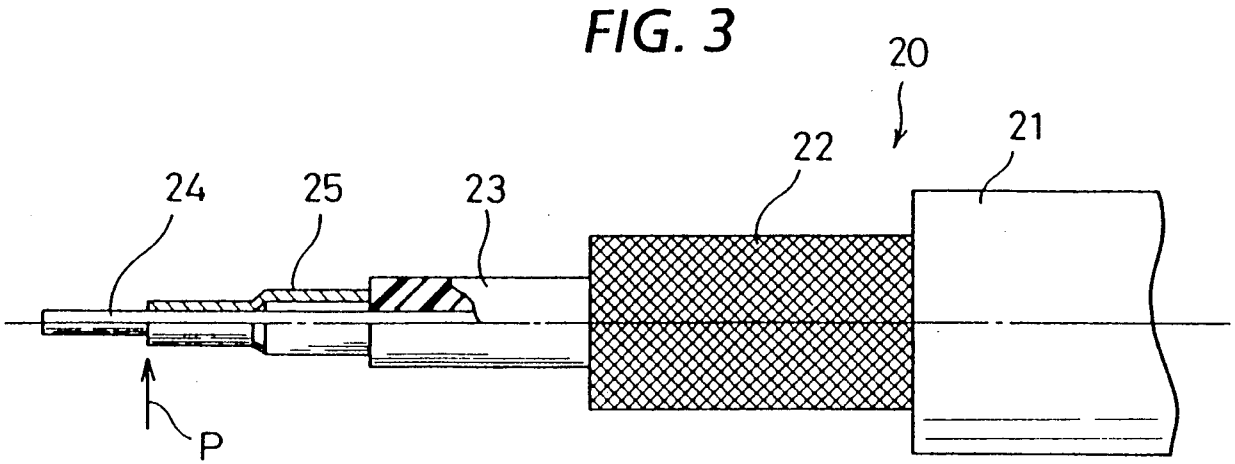
FIG. 3 is a side elevational view, partially in section, of a coaxial cable before connect to the connector.

The above coaxial cable connector is connected to a coaxial cable as follows:

(1) As FIG. 3 shows, a length of sheath 23 is removed to expose the shield wires 22, the inner insulator 23, and the central conductor 24. A reinforcing terminal 25 is fitted and crimped thereto. The central conductor 24 is then cut off at the front end P of the reinforcing terminal 25.

(2) As FIG. 1 shows, the sleeve 15 is loosely fitted over the prepared coaxial cable 20, and the trunk portion 7 with the slit 7A is pushed into between the shield wires 22 and the inner insulator 23 so that the reinforcing terminal 25 is pushed into the annular connection portion 3B. The slitted connection portion 3B resiliently expands and holds the reinforcing terminal 25. Since the trunk portion 7 and the annular connection portion 3B are concentric, it is only necessary to push the coaxial cable 20 into the connector so that the arm portion 7 enters between the inner insulator 23 and the shield wires 22 while the reinforcing terminal fits into the annular connection portion 3B.

(3) The sleeve 15 is moved from the coaxial cable 20 to such a position that covers the arm portion 7 and part of the sheath 21 as shown in FIG. 1 and crimped to secure the coaxial cable to the arm portion 7 as indicated by the two-dot chain line. Thus, the connection of the connector to the coaxial cable is completed.

(4) In order to couple a mating connector (not shown) to the connector with the cable, the mating connector is plugged into the coupling opening 8 of the outer shell 1. The outer shell of the mating connector expands the slitted trunk portion 5 so that the annular projection 10A snaps into the annular groove of the mating connector while the central conductor (not shown) of the mating connector fits into the annular connection portion 3A of the central terminal 3.

(5) The trunk portion 5 is expanded to such an extent that the annular groove 10 abuts on the stop ring 11. If the mating connector is forcefully plugged in/out by turning it back and forth, the trunk portion 5 resiliently expands the stop ring 11 within the range that the inner polygonal face becomes substantially circular. Thus, the forceful plugging in/out power is tolerated by the elastic deformation of the stop ring 11. When the stop ring 11 becomes substantially circular, no more expansion is possible.

According to the invention, the inner face of the stop ring is made polygonal so that when the mating connector is forcefully plugged in/out by turning it back and forth, it permits the outer shell to expand until it becomes substantially circular, thereby providing protection to the connector and increasing the service life.

What is claimed is:

1. A coaxial cable connector comprising:

a tubular outer conductive shell having a coupling opening, a slit extending upwardly from said coupling opening, and an annular groove on an outside surface adjacent said coupling opening; and a stop ring loosely fitted over said annular groove and having a polygonal inner face.

* * * * *